US006959697B2

(12) United States Patent
Kojima

(10) Patent No.: US 6,959,697 B2
(45) Date of Patent: Nov. 1, 2005

(54) FUEL SUPPLY SYSTEM FOR INTERNAL COMBUSTION ENGINE

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/963,830

(22) Filed: Oct. 14, 2004

(65) Prior Publication Data

US 2005/0092302 A1 May 5, 2005

(30) Foreign Application Priority Data

Oct. 30, 2003 (JP) ..... 2003-370952

(51) Int. Cl.[7] ..... F02M 37/04; F02M 41/00
(52) U.S. Cl. ..... 123/516; 123/467
(58) Field of Search ..... 456/516, 514, 456/518, 519, 520, 456, 179.17, 497; 123/467

(56) References Cited

U.S. PATENT DOCUMENTS 5,074,272 A * 12/1991 Bostick et al. ..... 123/514
5,558,068 A * 9/1996 Kunishima et al. ..... 123/516
6,021,763 A * 2/2000 Yoshihara et al. ..... 123/516
6,058,912 A * 5/2000 Rembold et al. ..... 123/516
6,267,104 B1 * 7/2001 Monnier ..... 123/516
6,615,807 B2 * 9/2003 Rembold et al. ..... 123/516
6,769,414 B2 * 8/2004 Rembold et al. ..... 123/514

FOREIGN PATENT DOCUMENTS

JP A 7-158536 6/1995
JP A 11-351088 12/1999
JP A 2002-317669 10/2002

* cited by examiner

*Primary Examiner*—Carl S. Miller
(74) *Attorney, Agent, or Firm*—Oliff & Berridge, PLC

(57) ABSTRACT

The volume of gas bubbles required in a fuel supply path in order to prevent the fuel pressure from rising again after an electromagnetic valve is closed is estimated. For example, the required volume of gas bubbles can be estimated according to the predicted rise of the fuel temperature in the fuel supply path after the engine is stopped. Since the volume of gas bubbles depends on the opening period of the electromagnetic valve, it is possible to determine the period during which the electromagnetic valve is to be open from the estimated required volume of gas bubbles. When the engine is stopped, the electromagnetic valve is operated based on this valve opening period.

9 Claims, 5 Drawing Sheets

FUEL SUPPLY SYSTEM FOR INTERNAL COMBUSTION ENGINE

BACKGROUND OF THE INVENTION

1. Field of the Invention

The present invention relates to a fuel supply system where pressurized fuel is supplied by a fuel pump from a fuel supply path to a fuel injector. In particular, the invention relates to a fuel supply system which is suitably applicable to a direct-injection engine where high-pressure fuel is directly supplied into a cylinder.

2. Background Art

In the field of internal combustion engines for automobiles, various techniques have recently been proposed as measures to improve the exhaust emission. For example, a technique disclosed in Japanese Patent Laid-open No. 2002-317669 (hereinafter referred to as "Patent Document 1") is proposed as a solution to prevent fuel leakage from the fuel injector when the engine is stopped.

Generally, automotive engines are configured such that from a fuel tank, pressurized high-pressure fuel is supplied by a fuel pump to the fuel injector of each cylinder by way of a delivery pipe serving as a fuel supply path. A check valve is provided on the output side of the fuel pump so that the fuel pressure is kept high in the delivery pipe even if the fuel pump is stopped.

Due to the structure of the fuel injector, however, if the fuel injector continues to be subject to the high fuel pressure, it is possible that fuel may leaks from the fuel injector in terms of the configuration thereof. The fuel leaked while the engine is at rest may be emitted as unburnt fuel when the engine is started later. This may aggravate the exhaust emission. In particular, in the case of a direct-injection engine which directly supplies fuel into the cylinders, since the fuel leaked into the cylinders are directly emitted without being burnt if the cylinders are in the exhaust stage, the possibility of the fuel leak aggravating the exhaust emission is particularly high.

As such, disclosed in Patent Document 1 is a solution to prevent fuel from leaking from the fuel injector when the engine is stopped. According to this prior art technique, a fuel return path is added between the delivery pipe and the fuel tank and this return path is provided with an electromagnetic valve. When the engine is stopped, the electromagnetic valve is opened according to the fuel temperature estimated from the intake air temperature. This lowers the fuel pressure in the delivery pipe and therefore prevents the fuel injector from leaking fuel.

As described below, however, it is difficult to reliably prevent the fuel injector from leaking fuel merely by opening the electromagnetic valve according to the fuel temperature as mentioned above when the engine is stopped.

While the engine is running, the fuel in the delivery pipe not only receives heat from the engine but also is cooled by low temperature fuel supplied from the fuel pump. After the engine is stopped, the fuel temperature in the delivery pipe rises for a while since the fuel continues to receive residual heat from the engine although the fuel pump stops. It is therefore possible that after the fuel pressure is lowered by opening the electromagnetic valve, the fuel pressure may rise again due to the succeeding rise of the fuel temperature which causes the fuel in the delivery pipe to expand. The above-mentioned prior art techniques do not consider such a rise of the fuel temperature after the engine is stopped.

In addition, while above-mentioned prior art techniques open the electromagnetic valve for a predetermined period of time, this valve opening period, if not appropriate, causes the following problem.

While the engine is running, the fuel temperature is about 60° C. At this temperature, the saturation vapor pressure of the fuel is about 150 kpa. If the fuel pressure is lower than this saturation vapor pressure, the fuel boils to generate gas bubbles therein. While the engine is running, it is not likely to generate gas bubbles since the fuel pressure is higher than the saturation vapor pressure. If the electromagnetic valve is opened, however, the fuel pressure in the delivery pipe falls to the internal pressure of the fuel tank. Since the internal pressure of the tank is substantially equal to the atmospheric pressure (about 100 kpa) lower than the saturation vapor pressure of the fuel, the fuel in the delivery pipe boils to generate abundant gas bubbles therein if an excessively long valve opening period is set to the electromagnetic valve. Excessively abundant gas bubbles results in bad starting performance of the engine since they retard the rise of the fuel pressure when the engine is restarted.

SUMMARY OF THE INVENTION

The present invention has been made to solve the above-mentioned problem. It is an object of the present invention to provide a fuel supply system for an internal combustion engine capable of reliably preventing fuel leakage from the fuel injectors when the engine is stopped without causing deterioration in the restarting performance.

In accordance with one aspect of the present invention, the fuel supply system for an internal combustion engine comprises a fuel supply path and an electromagnetic valve. The fuel supply path is connected with a fuel injector of the engine. The electromagnetic valve, if opened, releases fuel from the fuel supply path in order to lower a fuel pressure in the fuel supply path. When the engine is stopped, the electromagnetic valve is operated based on a required valve opening period during which the electromagnetic valve is to be open. The required valve opening period is determined from a estimated required volume of gas bubbles in the fuel supply path to prevent the fuel pressure from rising again after the electromagnetic valve is closed.

In accordance with another aspect of the present invention, the fuel supply system for an internal combustion engine comprises a fuel supply path and an electromagnetic valve. The fuel supply path is connected with a fuel injector of the engine. The electromagnetic valve, if opened, releases fuel from the fuel supply path in order to lower a fuel pressure in the fuel supply path. When the engine is stopped, the electromagnetic valve is momentarily opened. If the fuel pressure in the fuel supply path rises to the lowest operating pressure of the electromagnetic valve, the electromagnetic valve is momentarily opened again.

Other objects and further features of the present invention will be apparent from the following detailed description when read in conjunction with the accompanying drawings.

DESCRIPTION OF THE PREFERRED EMBODIMENT

First Embodiment

Figure 1:
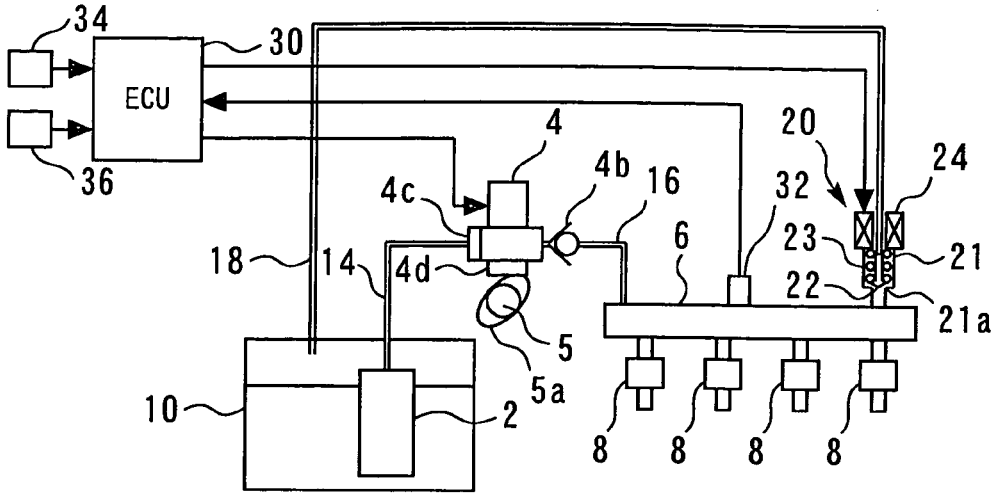
FIG. 1 illustrates the configuration of a fuel supply system for an internal combustion engine according to a first embodiment of the present invention.
Figure 2:
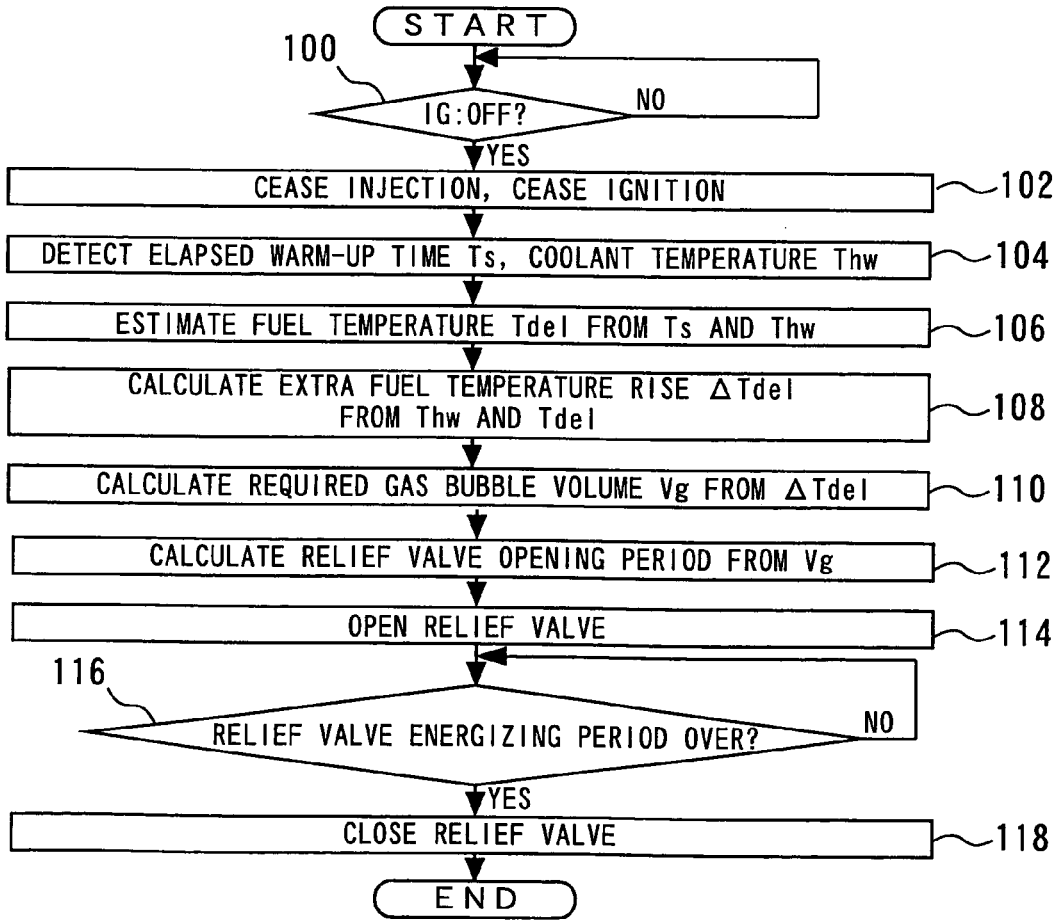
FIG. 2 is a flowchart illustrating a routine for the fuel pressure-lowering control that is executed in accordance with the first embodiment of the present invention.
Figure 3:
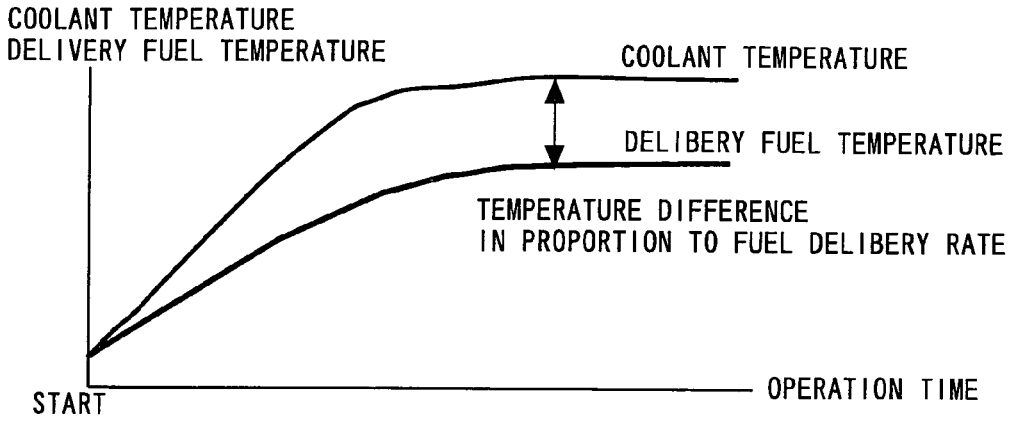
FIG. 3 is a graph showing how the engine coolant temperature and the delivery fuel temperature change with time after the engine is started.

With reference to FIGS. 1 to 3, a first embodiment of the present invention will be described below.

Figure 4:
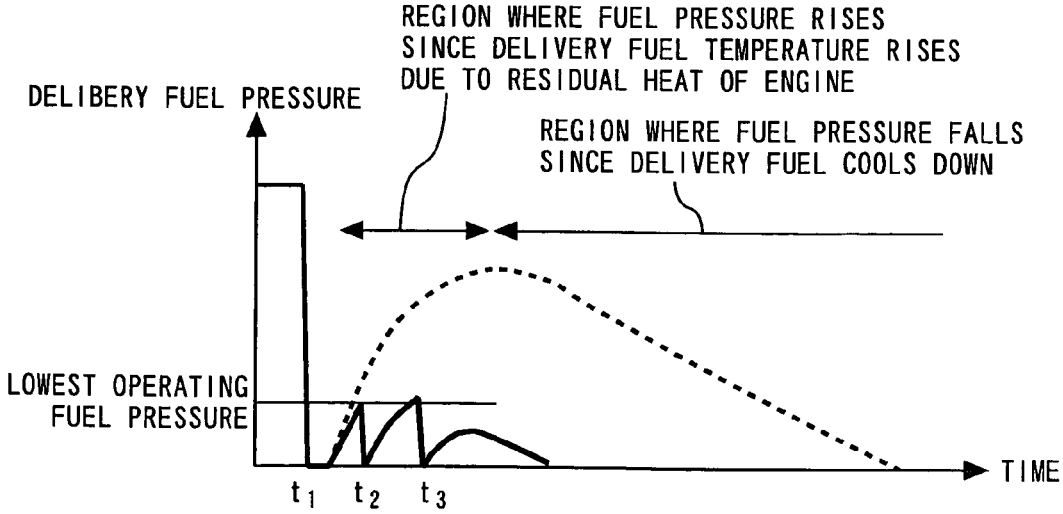
FIG. 4 is a flowchart illustrating a routine for the fuel pressure-lowering control that is executed in accordance with a second embodiment of the present invention.

FIG. 1 schematically shows the configuration of a fuel supply system for an internal combustion engine according to the first embodiment of the present invention. In FIG. 4, this fuel supply system is applied to an in-line four-cylinder engine and has a total of four fuel injectors 8. While this fuel supply system is applicable not only to a direct-injection engine where fuel is directly supplied into the cylinders but also to an engine which forms fuel-air mixture in the exterior of the cylinders such as an MPI engine, the following does not assume a specific engine type as the type of the engine to which this fuel supply system is applied. Note that in the case of a direct injection engine, the fuel injectors 8 are mounted so that their nozzles may be located inside the cylinders.

In this fuel supply system, the fuel injectors 8 are connected to a delivery pipe 6 from which fuel is supplied. The delivery pipe 6 is an accumulator in which pressurized fuel is accumulated. The pressure of fuel in the delivery pipe 6 can be detected by a pressure sensor 32 attached to the delivery pipe 6. The delivery pipe 6 is connected to a metering high-pressure pump 4 by way of a fuel supply pipe 16 so that high-pressure fuel, pressurized by the high-pressure pump 4, is supplied.

By a fuel supply pipe 14, the high-pressure pump 4 is connected to an electric low-pressure feed pump 2 located in a fuel tank 10. As the high-pressure pump 4, a plunger pump is used. Fuel is supplied into a plunger room (not shown in the figure) from the feed pump 2 and pressurized by a reciprocating plunger 4*a* so that fuel is forced to feed into the delivery pipe 6 through a check valve 4*b* provided at the discharge port. Since the plunger 4*a* is forced by a spring (not shown in the figure) to follow a cam 5 formed on a camshaft 5 of the engine, it reciprocates in conjunction with the rotation of the camshaft 5 in the engine. That is, the high-pressure pump 4 pumps fuel into the delivery pipe 6 in conjunction with the rotation of the engine. In addition, a metering valve 4*c* is provided at the inlet port of the high-pressure pump 4. The metering valve 4*c* is an electromagnetic valve which controls the communication between the plunger chamber and the fuel supply pipe 14. To regulate the fuel pressure in the delivery pipe 6, the quantity of fuel supplied into the delivery pipe 6 from the high-pressure pump 4 is adjusted by changing the opening period of the metering valve 4*c*.

The fuel pressure in the delivery pipe 6 can be detected by a pressure sensor 32 attached to the delivery pipe 6. To an ECU (Electronic Control Unit) 30 which is the controller of this fuel supply system, the pressure sensor 32 outputs a signal which depends on the fuel pressure. By controlling the metering valve 4*c,* the ECU 30 adjusts the quantity of fuel supplied from the high-pressure pump 4 into the delivery pipe 6 so that the fuel pressure detected by the pressure sensor 32 may be regulated to a target pressure.

The delivery pipe 6 is provided with an electromagnetic relief valve (an electromagnetic valve according to the present invention) 20 to release the internal fuel. The relief valve 20 is a normally closed valve and comprises: a housing 21 having a valve seat 21*a* formed thereon; a valve plug 22 located within the housing 21; a spring 23 to press the valve plug 22 to the valve seat 21*a;* and a solenoid 24 which magnetically drives the valve plug 22. The direction of the force given to the valve plug 22 by the spring 23 is opposite to the acting direction of the fuel pressure. When the force given to the valve plug 22 by the fuel pressure exceeds the force exerted by the spring 23, the valve plug 22 departs from the valve seat 21*a*. This fuel pressure is called the valve opening pressure of the relief valve 20. The relief valve 20 is connected with a relief pipe 18, which communicates with the fuel tank 10. If the relief valve 20 opens, the fuel in the delivery pipe 6 is released to the fuel tank 10.

By energizing the solenoid 24 to give magnetic force to the valve plug 22, it is also possible to forcibly drive the valve plug 22 so as to open the relief valve 20. The attraction needed for the solenoid 24 to drive the valve plug 22 is equal to the difference between the force given by the spring 23 and the force given by the fuel pressure. The lower the fuel pressure, the larger the attraction of the solenoid 24 must be made. The fuel pressure which corresponds to the maximum attraction of the solenoid 24, or the lowest fuel pressure above which the relief valve 20 can be opened by the force of the solenoid 24 is called the lowest operation pressure of the relief valve 20. According to the change of the fuel pressure in the delivery pipe 6 detected by the pressure sensor 32, it is possible to judge whether the relief valve 20 has operated.

By allowing the solenoid 24 to forcibly open the relief valve 20, it is possible to release fuel from the delivery pipe 6 and thus reduce the fuel pressure in the delivery pipe 6. In order to reduce the fuel pressure and thus prevent fuel leakage from the fuel injector 8, this fuel supply system forcibly opens the relief valve 20 by the solenoid 24 when the engine is at rest.

This fuel supply system is characterized by how to setting the valve opening period when forcibly opening the relief valve 20. More specifically, the valve opening period is determined by considering the volume of gas bubbles generated in the delivery pipe 6 due to the reduced fuel pressure. If the relief valve 20 opens, the delivery pipe 6 communicates with the fuel tank 10. Thus, the fuel pressure in the delivery pipe 6 falls substantially to the atmospheric pressure as in the fuel tank 10. Immediately after the engine is stopped, the fuel temperature in the delivery pipe 6 is about 60 degrees. At this temperature, the saturation vapor pressure of the fuel (gasoline) is about 150 kpa, higher than the fuel pressure in the delivery pipe 6. Thus, fuel boils in the delivery pipe 6, generating gas bubbles therein.

After the engine is stopped, the fuel temperature in the delivery pipe 6 rises since residual heat is received from the engine. Therefore, if the delivery pipe 6 remains closed with the relief valve 20 closed, the fuel pressure in the delivery pipe 6 rises according as the temperature rises. In this case, the fuel pressure shows a rise of about 1 MPa for every temperature rise of 1° C. However, this holds only when the delivery pipe 6 is entirely filled with fuel. If there are gas bubbles in the delivery pipe 6, the volume of the gas bubbles allow the fuel to expand. That is, if gas bubbles exist therein, the fuel pressure does not rise until the expansion of the fuel exceeds the volume of the gas bubbles. In this case, the fuel pressure begins to rise after the gas bubbles are eliminated by the expanding fuel.

To quickly raise the fuel pressure when the engine is started, it is preferable to minimize the gas bubbles in the delivery pipe 6. On the other hand, when the engine is stopped, the gas bubbles should be abundant enough to prevent the fuel pressure from rising again after the relief valve 20 is closed. To simultaneously meet these requirements which respectively concern the starting performance for such a restart and the prevention of fuel leakage, gas bubbles are generated by taking into account the expansion of the fuel after the relief valve 20 is closed. The volume of the gas bubbles is proportional to the period during which the delivery pipe 6 is open to the atmospheric pressure, that is, the relief valve 20 is opend.

Control of the relief valve 20 is performed by the ECU 30, which is the controller of this fuel supply system. The ECU 30 controls the relief valve 20 based on the signals from the pressure sensor 32, IGSW (ignition switch) 34, engine coolant temperature sensor 36 and other sensors and switches. With reference to a flowchart shown in FIG. 2, the following will describe in detail how the ECU 30 controls the relief valve 20 when the engine is stopped. Note that the purpose of the control described below is to lower the fuel pressure in the delivery pipe 6 and therefore this control is denoted below as the fuel pressure-lowering control.

FIG. 2 is a flowchart provided to describe the flows of the fuel pressure-lowering control executed by the ECU 30 as the controller of this fuel supply system. Firstly, in the routine of FIG. 2, it is judged whether the IGSW 34 is turned off (step 100). If the judgment result is that the IGSW 34 is turned off, control advances to the next step 102 by which fuel injection from the fuel injectors 8 and ignition by the ignition plugs not shown in the figure are ceased. This stops the engine.

In the next step 104, Ts and Thw are detected. Ts is the elapsed time (warm-up time) since the engine was started whereas Thw is the temperature of the engine cooling water (hereinafter, referred to as engine coolant temperature). The elapsed time Ts is measured by an internal timer of the ECU 30 whereas the engine coolant temperature Thw is detected by the engine coolant temperature sensor 36.

The ECU 30 is internally provided with a map to estimate the fuel temperature (delivery fuel temperature) Tdel in the delivery pipe 6 from the elapsed time Ts and engine coolant temperature Thw as parameters. The next step 106 calculates a delivery fuel temperature Tdel which corresponds to the elapsed time Ts and engine coolant temperature Thw detected in step 104. Note that the relation between the engine coolant temperature Thw and the delivery fuel temperature Tdel can be represented by a graph of FIG. 3. FIG. 3 is a graph showing how the engine coolant temperature Thw and the delivery fuel temperature Tdel change with time after the engine is started. As apparent from this figure, there is a difference between the engine coolant temperature Thw and the delivery fuel temperature Tdel. It is known that this temperature difference is in proportion to the fuel delivery rate.

In the next step 108, the extra rise ΔTdel of the delivery fuel temperature is calculated according to Equation (1) below:

$$\Delta Tdel=(Thw-Tdel)\times\text{Correction Coefficient} \quad (1)$$

According to Equation (1), the delivery fuel temperature Tdel rises depending on the difference between the temperature and the engine coolant temperature Thw. Correction Coefficient in Equation (1) above is dependent on such factors as the efficiency of heat transfer from the engine to the fuel in the delivery pipe 6 and can be determined by experiment or the like.

In the next step 110, the required volume of gas bubbles is calculated from the extra delivery fuel temperature rise ΔTdel according to Equation (2) below:

$$Vg=\Delta Tdel\times\text{Delivery Volume}\times\text{Thermal Expansion Coefficient of Fuel} \quad (2)$$

Delivery Volume in Equation (2) above is the capacity of the delivery pipe 6 and substantially equal to the volume of the fuel in the delivery pipe 6. Thus, the right side of Equation (2) is to calculate the expansion of the fuel. According to Equation (2), the expansion of the fuel is calculated as the required volume Vg of gas bubbles.

The ECU 30 is internally provided with a map to set the opening period of the relief valve 20 based on the required gas bubble volume Vg as a parameter. The map is prepared in advance based on experimental results and so on. In the map, the period of time during which the relief valve 20 should remain closed is in proportion to the required gas bubble volume Vg. In the next step 112, the opening period of the relief valve 20, which is in proportion to the required gas bubble volume Vg calculated in step 110, is calculated according to the map.

Then, the solenoid 24 is energized to open the relief valve 20 (step 114). The energized solenoid 24 gives to the valve plug 22 a magnetic force which opens the relief valve 20 by driving the valve plug 22 in the direction against the force exerted by the spring 23. During the valve opening period calculated in step 114, the solenoid 24 is kept energized (step 116). If the valve opening period is over, energizing the solenoid 24 is ceased to close the relief valve 20 (step 118).

According to the fuel pressure-lowering control described so far, the valve opening period of the relief valve 20 is determined from the volume of gas bubbles required to prevent the fuel pressure from rising again after the relief valve 20 is closed. Since the relief valve 20 is operated during this period, it is possible to prevent the fuel pressure from rising again without generating gas bubbles excessively in the delivery pipe 6. Therefore, without causing deterioration in the starting performance of the engine, this fuel supply system can surely prevent fuel leakage through the fuel injectors 8 when the engine is stopped.

Note that in the first embodiment mentioned so far, "required gas bubble volume estimating means" is implemented through execution of the step 104 through step 110 processes by the ECU 30. In addition, "valve opening period calculating means" is implemented through execution of the step 112 process by the ECU 30. As well, "electromagnetic valve control means" is implemented through execution of the step 114 through step 118 processes by the ECU 30.

Second Embodiment

With reference to FIG. 4, a second embodiment of the present invention will be described below.

A fuel supply system of this embodiment can be implemented by modifying the first embodiment so that another fuel pressure lowering control defined by a time chart of FIG. 4, instead of the fuel pressure lowering control routine of FIG. 2, may be executed by the ECU 30. FIG. 4 is a time chart provided to describe the control flows executed by the ECU 30 to control the relief valve 20 according to the changing fuel pressure.

Whereas the aforementioned first embodiment prevents the fuel pressure from rising again by controlling the volume of gas bubbles in the delivery pipe 6 through the opening period of the relief valve 20, this embodiment prevents it by repeatedly operating the relief valve 20 as necessary. Specifically, the ECU 30 momentarily operates the relief valve 20 as shown in FIG. 4 when the engine is stopped (namely the IGSW 34 is turned off) (time t1). Here, to momentarily operate the relief valve 20 means to open the relief valve 20 for a very short period (not longer than 1 second) to reduce the fuel pressure in the delivery pipe 6 whereas the relief valve 20 is opened for a considerably long period (some ten seconds necessary to generate gas bubbles) in the first embodiment.

Operating the relief valve 20 for such a short period does not generate gas bubbles in the delivery pipe 6. Therefore, the fuel pressure in the delivery pipe 6, influenced by the residual heat in the engine, would greatly rise as indicated by the broken line of FIG. 4. Although the fuel pressure in the delivery pipe 6 would sometime fall as the engine cools down, the possibility of fuel leakage through the fuel injectors 8 is high while the fuel pressure is greatly rising.

In the case of this fuel supply system, the fuel pressure is monitored by the ECU 30 after the relief valve 20 is operated. It is judged whether the fuel pressure has risen to the lowest operating pressure (lowest operating fuel pressure) of the relief valve 20. If the fuel pressure reaches the lowest operating pressure (time t2), the ECU 30 momentarily operates the relief valve 20 again. Likewise, if the fuel pressure rises to the lowest operating pressure again (t3), the ECU 30 momentarily operates the relief valve 20 again.

According to the fuel pressure lowing control described so far, the fuel pressure in the delivery pipe 6 is kept below the lowest operating pressure. In addition, since opening the relief valve 20 is just momentary, gas bubbles are not excessively generated in the delivery pipe 6. Therefore, like the first embodiment, this fuel supply system can surely prevent fuel leakage through the fuel injectors 8 when the engine is stopped without causing deterioration in the starting performance of the engine.

In addition, since the fuel pressure in the delivery pipe 6 is as high as several MPa when the engine is stopped, opening the electromagnetic relief valve 20 releases fuel from the delivery pipe 6 in a short period and therefore quickly lowers the fuel pressure. To merely lower the fuel pressure, the electromagnetic relief valve 20 must not be opened for more than a very short period. To generate gas bubbles in the delivery pipe 6, however, considerable time is necessary since fuel is slowly released due to the fuel pressure in the delivery pipe 6 lowered to the saturation vapor pressure (about 0.1 MPa). In the aforementioned first embodiment, the relief valve 20 must be energized for some ten seconds to keep the opening thereof. In the case of the second fuel supply system embodiment, the relief valve 20 must not be opened for more than 1 second to merely lower the fuel pressure although the valve must be opened repeatedly. Therefore, this fuel supply system can reduce the electric power consumption since it must not be energized so long in total.

In the second embodiment described so far, "electromagnetic valve control means" is implemented through execution of the above-mentioned control by the ECU 30.

Third Embodiment

Figure 5:
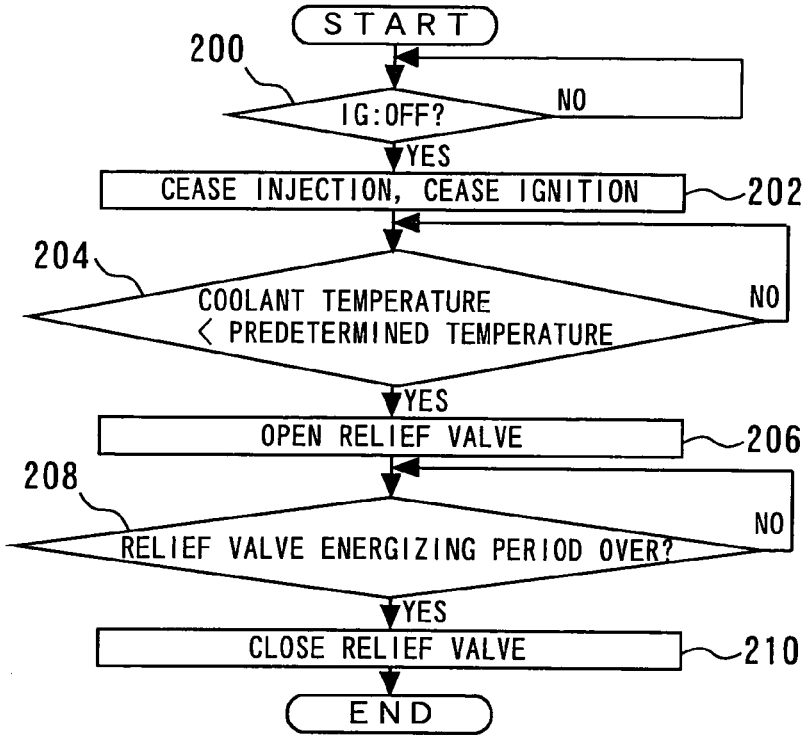
FIG. 5 is a flowchart illustrating a routine for the fuel pressure-lowering control that is executed in accordance with a third embodiment of the present invention.
Figure 6A:
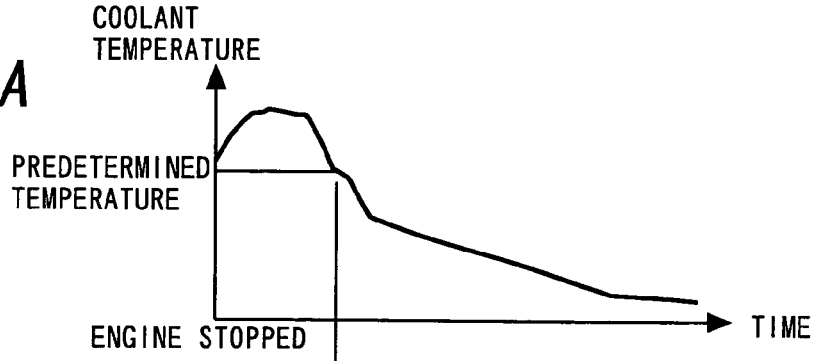
FIG. 6A is a graph which show how the engine coolant temperature changes with time after the engine is stopped.
Figure 6B:
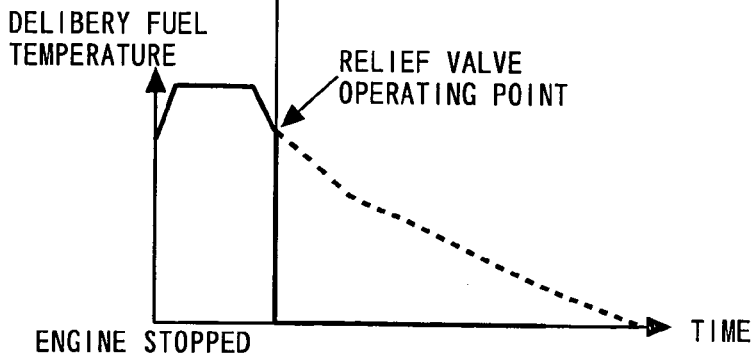
FIG. 6B is a graph which show how the fuel pressure in the delivery pipe changes with time after the engine is stopped.

With reference to FIGS. 5, 6A and 6B, a third embodiment of the present invention will be described below.

A fuel supply system of this embodiment can be implemented if a routine of FIG. 5 is executed by the ECU 30 in the configuration of FIG. 1.

FIG. 5 is a flowchart provided to describe the flows of another fuel pressure lowering control executed by the ECU 30 in this fuel supply system. The routine of FIG. 5 does not unconditionally operate the relief valve 20 immediately after the engine is stopped. The relief valve 20 is not operated unless the engine coolant temperature is lower than a prescribed value. This is intended as described below.

As a situation where the vehicle is used, assume that after the engine is run at very hot temperature, it is stopped and then immediately restarted. For example, the vehicle resumes climbing a gradient with a trailer or the like in a very hot season after a short break. In this case, the temperature of and around the delivery pipe 6 gets very high (for example, about 120° C.) due to the residual heat from the exhaust system as well as the engine. If the relief valve 20 is opened in this situation, gas bubbles occur abundantly in the delivery pipe 6 since the fuel boils due to the lowered fuel pressure. Although the gas bubbles decrease according as the fuel cools down and the fuel pressure falls, the fuel does not immediately begin to cool down. Rather, the fuel temperature rises due to the residual heat of the engine or the like immediately after the engine is stopped. In addition, since the engine direct-operating type high-pressure pump 4 is not operating when the engine is stopped, fuel is fed under pressure by the feed pump 2. Therefore, the fuel pressure in the delivery pipe 6 does not rise above the feed pressure. Accordingly, if the engine is restarted after a short break, fuel cannot sufficiently be supplied to the fuel injectors 8 since gas bubbles are abundant in the delivery pipe 6. In addition, if the configuration is designed so that fuel injection is not started until the fuel pressure reaches a required level, starting performance deteriorates since it takes time to raise the fuel pressure due to gas bubbles.

To prevent such starting troubles as mentioned above when the engine is restarted, this fuel supply system does not operate the relief valve 20 until the engine coolant temperature falls below a predetermined level (for example, 100° C). Specifically, according to the routine of FIG. 5, it is judged at first whether the IGSW 34 is turned off (step 200). If the judgment result is that the IGSW 34 off, control advances to step 202 by which fuel injection from the fuel injectors 8 and ignition by the ignition plugs not shown in the figure are ceased. This stops the engine.

After the injection and ignition are ceased, the engine coolant temperature is detected by the engine coolant temperature sensor 36 and compared with the predetermined temperature (step 204). FIGS. 6A and 6B are graphs which contrastively show how the engine coolant temperature and the fuel pressure (delivery fuel pressure) in the delivery pipe 6 change with time after the engine is stopped. As apparent in FIG. 6A, after the engine is stopped, the engine coolant temperature rises for a while due to the residual heat of the engine and then begins to gradually fall.

If it is judged in step 204 that the engine coolant temperature has fallen below the predetermined temperature, control advances to the next step 206 which energizes the solenoid 24 to open the relief valve 20. The energized solenoid 24 gives to the valve plug 22 a magnetic force which opens the relief valve 20 by driving the valve plug 22 in the direction against the force exerted by the spring 23. During a predetermined period, the solenoid 24 is kept energized (step 208). If the predetermined period is over, energizing the solenoid 24 is ceased to close the relief valve 20 (step 210). This releases fuel from the delivery pipe 6 and lowers the fuel pressure as shown in FIG. 6B. Since the engine coolant temperature continues to fall further after the relief valve 20 is closed, the fuel pressure does not rise again.

According to the fuel pressure lowering control described so far, since opening the relief valve 20 after the engine is stopped is prohibited until the engine coolant temperature falls below the predetermined temperature, the fuel pressure in the delivery pipe 6 is kept without getting released if the engine is very hot. In this case, when the engine is restarted soon after the engine is stopped, high-pressure fuel is supplied from the delivery pipe 6 to the fuel injectors 8. Therefore, this fuel supply system can secure good restarting performance for the engine at high temperature.

In this fuel supply system, there is the possibility that fuel leakage may occur from the fuel injectors 8 due to the fuel pressure in the delivery pipe 6 before the relief valve 20 is opened since the relief valve 20 may be kept closed long after the engine is stopped. As apparent in FIG. 6B, however, the above-mentioned fuel pressure lowering control can quickly lower the fuel pressure as compared with the fuel pressure transition (denoted by a broken line) obtained without any such control. This faster fuel pressure lowering reduces the possibility of fuel leakage accordingly. Specifically, whereas it takes 1 or 2 hours to lower the fuel pressure without any fuel pressure lowering control, the fuel pressure can be lowered in 10 to 20 minutes with this fuel pressure lowing control.

In the above-mentioned third embodiment, "prohibiting means" is implemented through execution of the steps 200 through 206 by the ECU 30.

The function to prohibit opening the relief valve 20 depending on the engine coolant temperature is characteristic of the above-mentioned third embodiment. It is also possible to incorporate this function in either the first embodiment or the second embodiment. This can be implemented by making the ECU 30 execute steps 200 through 204 of the routine of FIG. 5 before the relief valve 20 is opened after the engine is stopped. In the case of the first embodiment, this can be implemented by modifying the configuration so that the ECU 30 executes steps 200 through 204 of the routine of FIG. 5 instead of steps 100 and 102 of the routine of FIG. 2.

Fourth Embodiment

Figure 7:
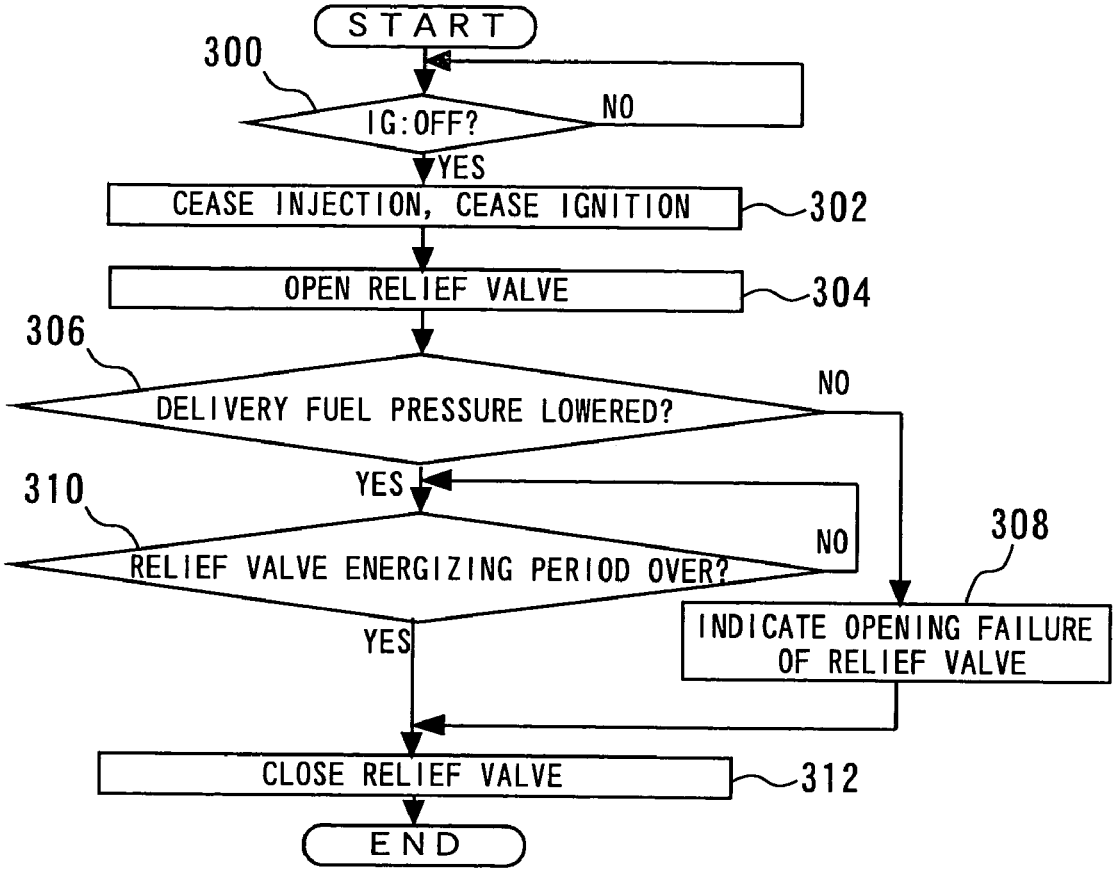
FIG. 7 is a flowchart illustrating a routine for the opening failure detection that is executed in accordance with a fourth embodiment of the present invention.

With reference to FIG. 7, a fourth embodiment of the present invention will be described below.

In each of the aforementioned embodiments, the relief valve 20 is a critical element in appropriately controlling the fuel pressure. If the closed relief valve 20 cannot be opened, the fuel pressure cannot be lowered when the engine is stopped. If the opened relief valve 20 cannot be closed, it is not possible to attain an appropriate fuel pressure while the engine is running. Therefore, if the relief valve 20 is out of order, the failure must be detected as early as possible. This fuel supply system of the embodiment can be implemented by modifying the configuration of FIG. 1 so that the ECU 30 executes a routine of FIG. 7. The fuel supply system of this embodiment is characterized by including a function to detect the failure of the relief valve 20, in particular, the opening failure of the closed relief valve 20.

FIG. 7 is a flowchart provided to describe the flows of an opening failure detecting routine executed by the ECU 30 in this fuel supply system. Firstly, in the routine of FIG. 7, it is judged whether the IGSW 34 is turned off (step 300). If the judgment result is that the IGSW 34 is turned off, control advances to the next step 302 by which fuel injection from the fuel injectors 8 and ignition by the ignition plugs not shown in the figure are ceased. This stops the engine.

After injection and ignition are ceased, the solenoid 24 is energized to open the relief valve 20 (step 304). If the relief valve 20 is normal, the energized solenoid 24 gives to the valve plug 22 a magnetic force which opens the relief valve 20 by driving the valve plug 22 in the direction against the force exerted by the spring 23. This releases fuel from the delivery pipe 6 and therefore lowers the fuel pressure. On the other hand, if the relief valve 20 cannot be opened due to such a trouble as a breaking of a wire, the fuel pressure is kept high since fuel is not released from the delivery pipe 6. In step 306, the change of the fuel pressure is measured according to the output signal from the pressure sensor 32 to judge whether the fuel pressure is lowered.

If the judgment result in step 306 is that the fuel pressure is not lowered, it can be considered that the relief valve 20 is failed and cannot be opened. In this case, a display in the cabin indicates that the relief valve 20 is failed (step 308).

On the other hand, if the judgment result in step 306 is that the fuel pressure is lowered, the relief valve 20 is normally functioning. In this case, the solenoid 24 is kept energized for a predetermined period (step 310). Then, if the predetermined period is over, energizing the solenoid 24 is ceased to close the relief valve 20 (step 312).

According to the opening failure detecting routine described so far, since the opening failure of the relief valve 20 can be detected from the change of the fuel pressure, no special means other than the existent pressure sensor 32 is required. Therefore, this fuel supply system can detect the opening failure of the relief valve 20 without raising the cost.

Note that in the fourth embodiment mentioned above, "opening failure detecting means" is implemented through execution of steps 306 and 308 by the ECU 30.

While the function to detect the opening failure of the relief valve 20 from the change of the fuel pressure is characteristic of the above-mentioned fourth embodiment, it is also possible to incorporate this function in any of the first through third embodiments. That is, this function in the fourth embodiment is widely applicable to any system which lowers the fuel pressure in the delivery pipe 6 by opening the relief valve 20.

Fifth Embodiment

Figure 8:
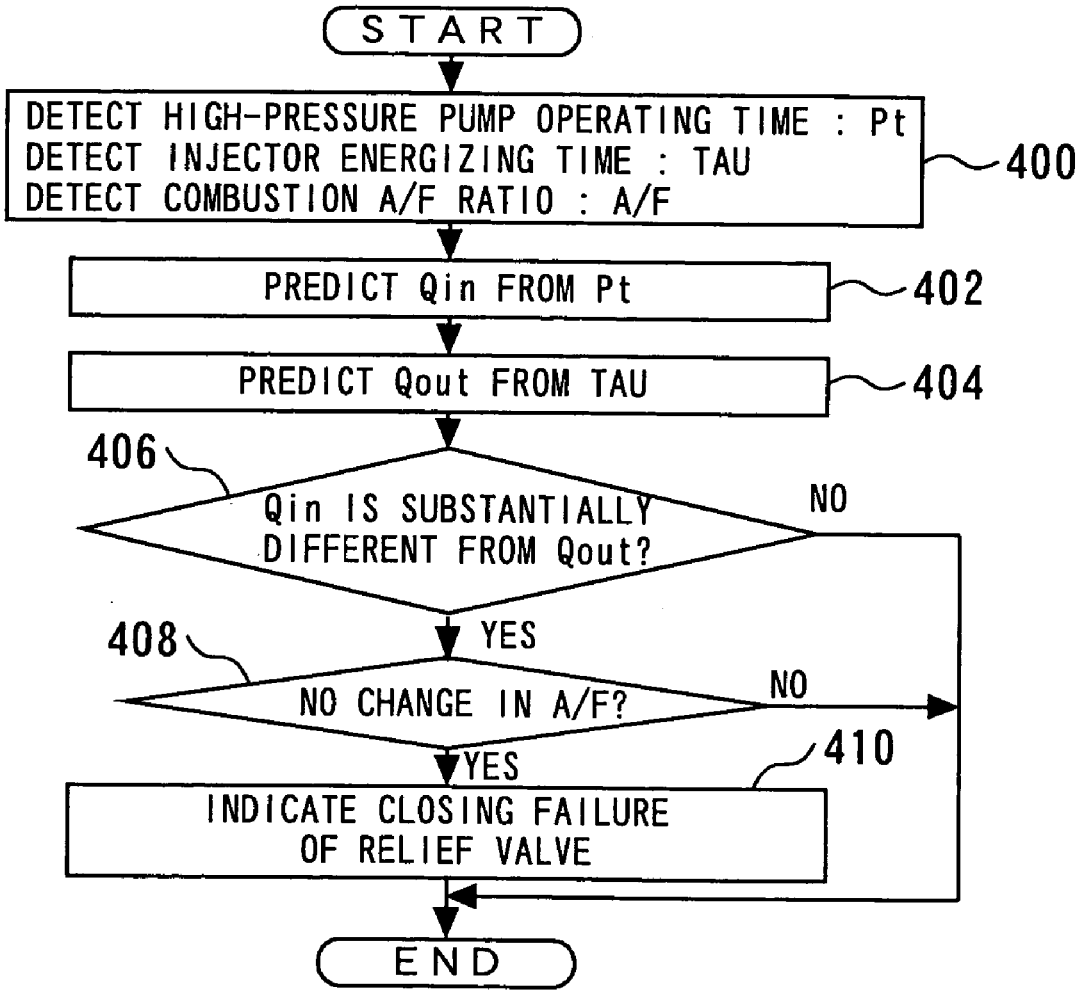
FIG. 8 is a flowchart illustrating a routine for the closing failure detection that is executed in accordance with a fifth embodiment of the present invention.

With reference to FIG. 8, a fifth embodiment of the present invention will be described below.

A fuel supply system of this embodiment can be implemented by modifying the configuration of FIG. 1 so that the ECU 30 executes a routine of FIG. 8. The fuel supply system is characterized by including a function to detect the failure of the relief valve 20, in particular, the closing failure of the opened relief valve 20.

FIG. 8 is a flowchart provided to describe the flows of a closing failure detection routine which is executed by the ECU 30 in this fuel supply system. Whereas any routine in the first through fourth embodiments is executed when the engine is stopped, the routine of FIG. 8 is executed while the engine is running. Firstly, the routine shown in FIG. 8 detects the operating time Pt of the high-pressure pump 4, the energizing time TAU of the fuel injector 8 and the combustion air/fuel ratio (step 400). The operating time Pt and the energizing time TAU are control parameters calculated in the ECU 30. The combustion air/fuel ratio A/F can be detected from the output signal of an air/fuel ratio sensor (or $O_2$ sensor) provided in the exhaust path of the engine.

Then, Qin is predicted from the operating time Pt wherein Qin is the quantity of fuel supplied to the delivery pipe from the high-pressure pump 4 (step 402). As well, Qout is predicted from the energizing time TAU wherein Qout is the quantity of fuel injected from the fuel injector (INJ.) 8 (step 404). Note that in steps 402 and 404, prediction is made on the assumption that the fuel pressure is controlled to a predetermined target level. In step 406, the supplied quantity Qin and injected fuel quantity Qout are compared to each other.

If the comparison result in step 406 is that the supplied fuel quantity Qin is larger than the injected fuel quantity Qout and the difference is beyond the fluctuant error magnitude, it is considered that fuel is leaking from somewhere. What may be leaking fuel include the relief valve 20 and the fuel injector 8. If fuel is leaked from the fuel injector 8 while it is not energized, the combustion air/fuel ratio A/F becomes a fuel-richer value than the target air/fuel ratio since fuel is excessively supplied into the engine. On the other hand, leak from the relief valve 20 does not have influence on the combustion air/fuel ratio A/F since the fuel leak merely goes back into the fuel tank 10. Accordingly, it is judged in the next step 408 whether the combustion air/fuel ratio A/F has changed.

If the judgment result in step 408 is that the combustion air/fuel ratio A/F has not changed, it is considered that fuel is leaking from the relief valve 20, that is, the relief valve 20 is certainly out of order and cannot be closed. In this case, for example, a display in the cabin indicates that the relief valve 20 is failed (step 410). Note that if the comparison result in step 406 is that the difference between the supplied fuel quantity Qin and the injected fuel quantity Qout is small or the judgment result in step 408 is that the combustion air/fuel ratio A/F has changed, the relief valve 20 is judged to be normal.

According to the closing failure detecting routine described so far, since the closing failure of the relief valve 20 is detected from control parameters (operating time Pt and energizing time TAU) calculated in the ECU 30 and the combustion air/fuel ratio A/F, no special means is needed for failure detection. Therefore, the fuel supply system can detect the closing failure of the relief valve 20 without raising the cost.

Note that in the fifth embodiment mentioned above, "supplied fuel quantity calculating means" is implemented through execution of step 402 by the ECU 30 and "consumed fuel quantity calculating means" is implemented through execution of step 404 by the ECU 30. In addition, "closing failure detecting means" is implemented through execution of step 406 by the ECU 30.

While the function to detect the closing failure of the relief valve 20 from the difference between the supplied fuel quantity and the consumed fuel quantity is characteristic of the above-mentioned fifth embodiment, it is also possible to incorporate this function in any of the first through fourth embodiments. That is, this function in the fifth embodiment is widely applicable to any system configured so that fuel is supplied from the high pressure pump 4 into the delivery pump 6 and the fuel is consumed by the fuel injector 8.

Others

While the embodiments of the present invention have been described, the present invention is not limited to these embodiments and various modifications may be made thereunto without departing from the spirit of the present invention. For example, the electromagnetic valve (electromagnetic relief valve) to which the present invention is applied may be configured so that the direction of the force given to the valve plug by the spring is identical to the acting direction of the fuel pressure.

The major benefits of the present invention described above are summarized follows:

According to a first aspect of the present invention, since a period during which the electromagnetic valve is to be open is determined according to the volume of gas bubbles required in the fuel supply path not to raise the fuel pressure again after the electromagnetic valve is closed, it is possible to prevent the fuel pressure from rising again without producing excessively abundant gas bubbles in the fuel supply path. That is, according to the present invention, it is possible to reliably prevent fuel leakage from the fuel injector at the time of stoppage without causing deterioration in the subsequent starting performance.

According to a second aspect of the present invention, since the required volume of gas bubbles is estimated from the predicted rise of the fuel temperature in the fuel supply path after the engine is stopped, it is possible to accurately estimate the required volume of gas bubbles consistent with the expansion of the fuel after the electromagnetic valve is closed.

According to a third aspect of the present invention, since the electromagnetic valve is momentarily re-opened if the fuel pressure rises above the lowest operating pressure of the electromagnetic valve, it is possible to prevent the fuel pressure from rising again. In addition, since opening the electromagnetic valve is momentary, gas bubbles are not excessively generated in the fuel supply path. That is, according to the present invention, it is possible to reliably prevent fuel leakage from the fuel injector at the time of stoppage without causing deterioration in the subsequent starting performance.

According to a fourth aspect of the present invention, the electromagnetic valve is prohibited to open when the engine is stopped until the coolant cools down to a predetermined temperature. Since the fuel pressure is therefore kept high, it is possible at very high temperature to secure high restarting performance.

According to a fifth aspect of the present invention, it is possible to detect the opening failure of the electromagnetic valve by a simple configuration without using special means.

According to a sixth aspect of the present invention, it is possible to detect the closing failure of the electromagnetic valve by a simple configuration without using special means.

What is claimed is:

1. A fuel supply system for an internal combustion engine, comprising:

a fuel supply path connected with a fuel injector of the engine;

an electromagnetic valve which, if opened, releases fuel from the fuel supply path in order to lower a fuel pressure in the fuel supply path;

required gas bubble volume estimating means for estimating a required volume of gas bubbles in the fuel supply path to prevent the fuel pressure from rising again after the electromagnetic valve is closed;

valve opening period calculating means for determining a required valve opening period during which the electromagnetic valve is to be open from the estimated required volume of gas bubbles; and electromagnetic valve control means for operating the electromagnetic valve based on the required valve opening period when the engine is stopped.

2. A fuel supply system for an internal combustion engine according to claim 1, wherein the required gas bubble volume estimating means predicts the rise of the fuel temperature expected to occur after the engine is stopped and estimates the required volume of gas bubbles from the predicted rise of the fuel temperature.

3. A fuel supply system for an internal combustion engine according to claim 1, further comprising:

water temperature detecting means for detecting a temperature of cooling water in the engine; and prohibiting means for prohibiting the electromagnetic valve from opening until the cooling water cools down to a predetermined temperature when the engine is stopped.

4. A fuel supply system for an internal combustion engine according to claim 1, further comprising:

opening failure detecting means for detecting an opening failure of the electromagnetic valve from the change of the fuel pressure in the fuel supply path when the electromagnetic valve is energized.

5. A fuel supply system for an internal combustion engine according to claim 1, further comprising:

supplied fuel quantity calculating means for calculating a quantity of fuel supplied to the fuel supply path;

consumed fuel quantity calculating means for calculating a quantity of fuel consumed by the fuel injector; and closing failure detecting means for detecting a closing failure of the electromagnetic valve from the difference between the quantity of fuel supplied and the quantity of fuel consumed.

6. A fuel supply system for an internal combustion engine, comprising:

a fuel supply path connected with a fuel injector of the engine;

an electromagnetic valve which, if opened, releases fuel from the fuel supply path in order to lower the fuel pressure in the fuel supply path fuel pressure detecting means for detecting a fuel pressure in the fuel supply path; and electromagnetic valve control means for momentarily opening the electromagnetic valve when the engine is stopped and, if the fuel pressure rises to the lowest operating pressure of the electromagnetic valve, momentarily opening the electromagnetic valve again.

7. A fuel supply system for an internal combustion engine according to claim 6, further comprising:

water temperature detecting means for detecting a temperature of cooling water in the engine; and prohibiting means for prohibiting the electromagnetic valve from opening until the cooling water cools down to a predetermined temperature when the engine is stopped.

8. A fuel supply system for an internal combustion engine according to claim 6, further comprising:

opening failure detecting means for detecting an opening failure of the electromagnetic valve from the change of the fuel pressure in the fuel supply path when the electromagnetic valve is energized.

9. A fuel supply system for an internal combustion engine according to claim 6, further comprising:

supplied fuel quantity calculating means for calculating a quantity of fuel supplied to the fuel supply path;

consumed fuel quantity calculating means for calculating a quantity of fuel consumed by the fuel injector; and closing failure detecting means for detecting a closing failure of the electromagnetic valve from the difference between the quantity of fuel supplied and the quantity of fuel consumed.

* * * * *